US006254489B1

(12) United States Patent
Drobnis et al.

(10) Patent No.: US 6,254,489 B1
(45) Date of Patent: Jul. 3, 2001

(54) AMUSEMENT ATTRACTION WITH MAN-MADE TORNADO

(75) Inventors: Nicholas H. Drobnis; Craig R. Hanna, both of Universal City; Philip D. Hettema, Los Angeles, all of CA (US); James H. Hightower; Cecil D. Magpuri, both of Orlando, FL (US); Edward S. Newquist, Glendale, CA (US)

(73) Assignee: Universal City Studios, Inc., Universal City, CA (US)

( * ) Notice: Subject to any disclaimer, the term of this patent is extended or adjusted under 35 U.S.C. 154(b) by 0 days.

(21) Appl. No.: 09/275,640

(22) Filed: Mar. 24, 1999

(51) Int. Cl.[7] ..... A63D 5/08
(52) U.S. Cl. ..... 472/65; 472/59; 472/60
(58) Field of Search ..... 472/59, 60, 61, 472/64, 65, 74, 130, 137; 415/2.1, 3.1, 4.1, 4.2, 4.3

(56) References Cited

U.S. PATENT DOCUMENTS

| | | | |
|---|---|---|---|
| 3,589,044 | 6/1971 | Morrison . | |
| 3,874,589 | 4/1975 | Yamada . | |
| 4,070,131 | 1/1978 | Yen . | |
| 4,215,500 | 8/1980 | Sharp . | |
| 4,258,912 | 3/1981 | Reighart, III . | |
| 4,452,562 | 6/1984 | Hsu . | |
| 4,836,521 | 6/1989 | Barber . | |
| 5,096,467 | 3/1992 | Matsui . | |
| 5,272,604 | 12/1993 | Lin . | |
| 5,322,646 | 6/1994 | Wright et al. . | |
| 5,403,238 * | 4/1995 | Baxter et al. | 472/43 |
| 5,616,083 | 4/1997 | Subbaraman et al. . | |
| 5,971,765 | 10/1999 | Gill et al. . | |

* cited by examiner

*Primary Examiner*—Kien T. Nguyen
(74) *Attorney, Agent, or Firm*—Lyon & Lyon LLP

(57) ABSTRACT

An amusement attraction is housed within a building. The building contains several different settings. Each setting contains a variety of scenic elements. One setting acts as a pre-show and includes an audio-visual presentation. A second setting is designed to resemble a tornado-damaged building. A third setting contains various scenic elements designed to resemble an outdoor scene. In the third setting, a special effects show takes place that includes a man-made tornado. Other special effects are used to simulate the effect of the tornado on the scenic elements in the outdoor scene. Guests can safely view the man-made tornado from a guest viewing area.

19 Claims, 12 Drawing Sheets

AMUSEMENT ATTRACTION WITH MAN-MADE TORNADO

BACKGROUND OF THE INVENTION

The present invention relates to amusement attractions. More specifically, the invention relates to a novel amusement attraction having a simulated tornado within a building.

Amusement attractions and theatrical shows that use special effects are well known. As technology advances and audiences become more sophisticated, special effects have become a more important part of these types of shows or attractions. To enhance the realism of live attractions and shows, various techniques have been used to recreate real environmental events (such as rain, wind, fire and the like).

One of the most terrifying, yet fascinating, environmental events is the tornado. Tornadoes have been created on small scales in laboratories for research purposes. See, Eagleman, Joe R., *Severe and Unusual Weather,* pp. 297–300, Von Nostrand Reinhold Co., 1983, incorporated herein by reference. Tornado effects and computer-generated tornado images have also been used in television and motion pictures. However, notwithstanding their terrifying nature, no amusement attraction or theatrical show has simulated a tornado. Accordingly, there remains a need for an amusement attraction that allows guests to safely view a real man-made tornado and provides the experience of being in a tornado disaster. There is also a need for an amusement attraction that houses such a man-made tornado inside a building.

SUMMARY OF THE INVENTION

An amusement attraction is housed within a building. Guests enter the building and walk through various scenes or settings. One setting is designed to look like an outdoor scene. A guest viewing platform faces the outdoor scene. The guests watch a special effects show that takes place in the outdoor scene. In an alternate embodiment, the guests view the outdoor scene while seated in ride vehicles that travel along a track or other pathway. A tornado generating system in the building creates an actual physical and 3-dimensional tornado. The special effects show also includes moving scenery, props, show action equipment, lighting effects, sound effects, projection effects and fire effects. The result is that the guests feel like they are witnessing an actual tornado disaster.

DETAILED DESCRIPTION

Figure 1:
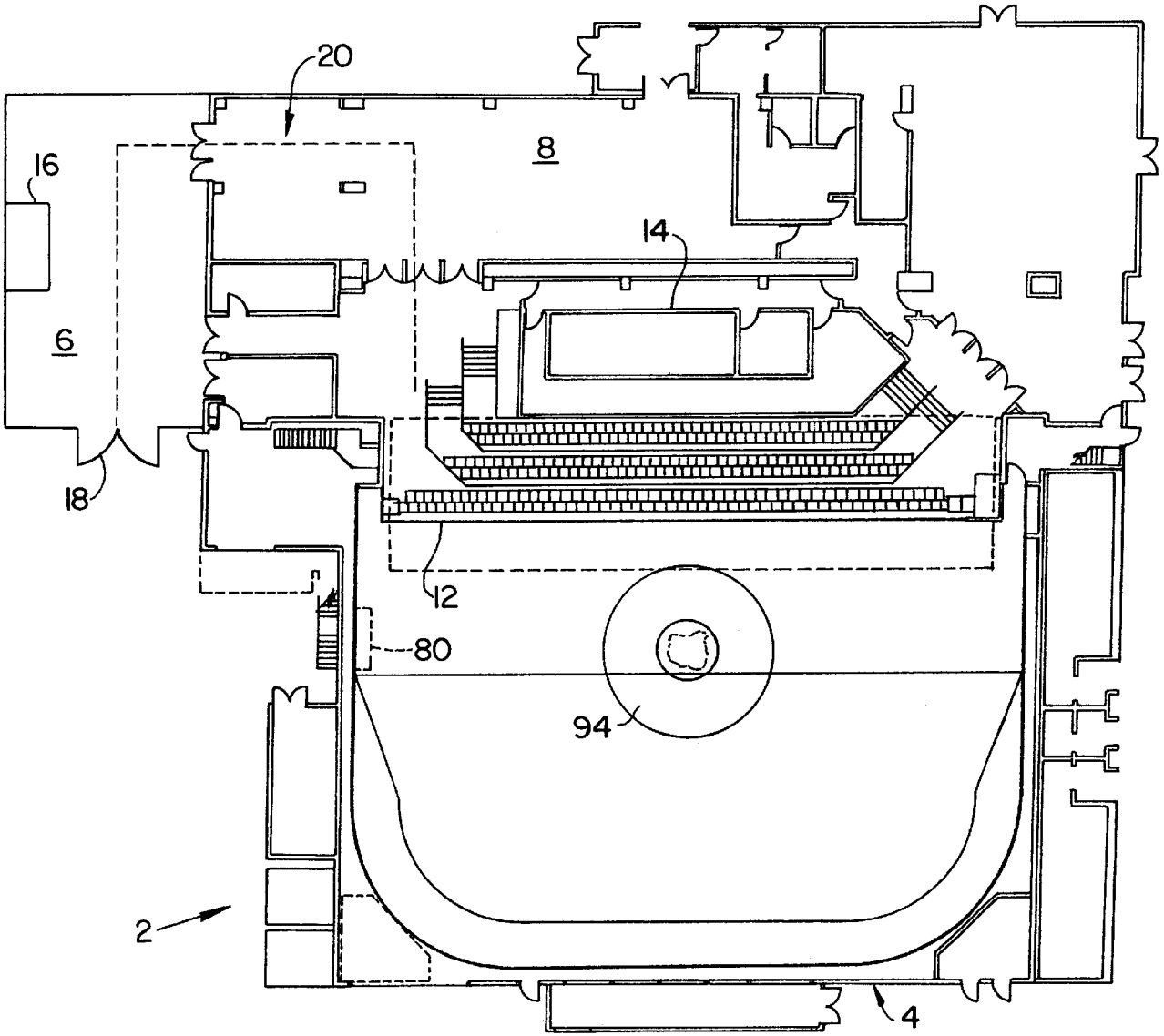
FIG. 1 is a plan view of the building used for the amusement attraction of the present invention.
Figure 2:
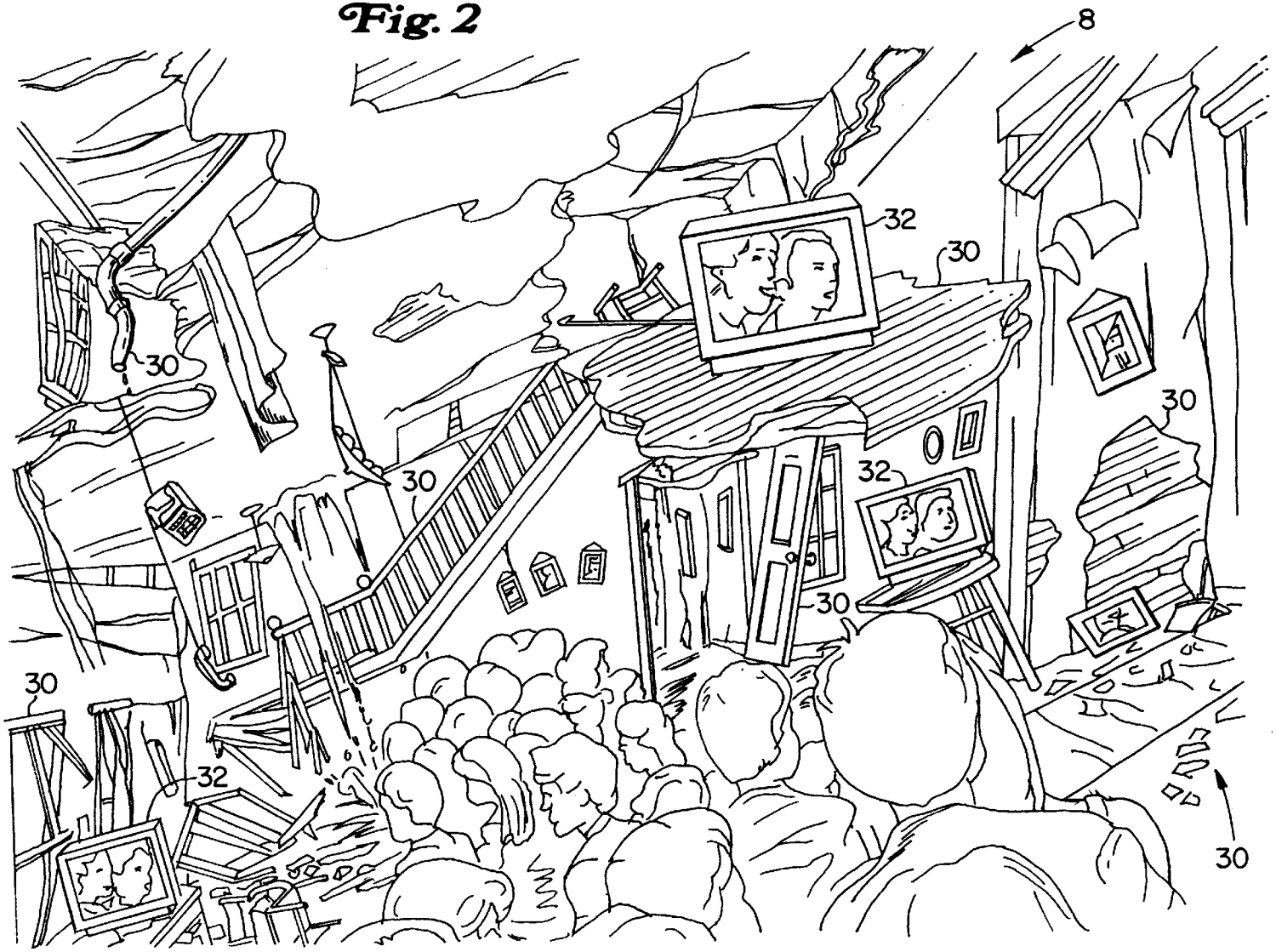
FIG. 2 is a schematic representation of the second setting in the amusement attraction of the present invention.

Referring now to the drawings in detail, and initially to FIG. 1, an amusement attraction 2 is housed within a building 4. The building contains a variety of settings (6, 8 and 10). In the preferred embodiment, there are three distinct settings in the building 4. Guests enter the building 4 through a main entrance 18. The first setting that the guests encounter is a pre-show 6. The pre-show 6 sets up the amusement attraction by providing audio-visual information to the guests. In the preferred embodiment, the audio-visual information is a video or film presentation 16. After the guests view the film presentation 16 they enter the second setting 8 via a walkway 20 having various scenic elements that are designed to resemble a tornado-damaged building, specifically, blown out windows, damaged doors, walls, ceilings and stairways, toppled furniture, broken pipes, shattered glass and the like as shown in FIG. 2. The second setting also contains several video monitors 32 on which a dramatization of a tornado disaster is shown.

Referring now to FIG. 3 through FIG. 7, the third setting 10 is designed to simulate an outdoor scene. The guests enter the third setting 10 via walkway 20 and stand on the guest viewing platform 12. The guest viewing platform 12 is arranged in tiers and faces the outdoor scene. In an alternate embodiment, the guest viewing platform 12 could contain rows of chairs. A canopy 40 is located above the guest viewing platform 12. The simulated outdoor scene contains a variety of scenic elements or scenery 48 such as buildings, vehicles, gasoline pumps, trees, fences, telephone or power poles, fire hydrants, signs and similar scenic elements.

Other scenic elements constitute forced perspective show sets 46, projection effects 50 (which are projected onto a large curved projection screen 52), show action equipment 54 (such as a flying prop), fire effects 56 and lighting and sound effects. A principal special effect is a man-made tornado 44 that appears in the middle of the outdoor scene. When the man-made tornado 44 is active, some of the scenery 48 moves or otherwise acts to simulate the effects of a real tornado. The combination of all of the above elements provides the guests with an extremely realistic, but simulated tornado experience.

In use, as the guests enter the third setting 10, wind starts to blow and is accompanied by the sound effect of thunder. The wind is created by various wind fans within the building 4 as described in detail below. The guests take their places on the guest viewing platform 12 which is located under the canopy 40. Spread out before the guests is an outdoor scene which could be designed to resemble a small Midwestern town. The outdoor scene includes the scenery 48. The wind picks up and lighting effects simulate a slowly darkening sky, using known techniques.

Simulated lightning appears in conjunction with the simulated sounds of thunder. The lightning appears to strike a tree, splitting it in two. As the wind intensifies, trees, signs and buildings (48) start to shake and rattle. Simulated rain begins to fall onto the guests and a fine mist fills the air.

Using projection effects, the image of a massive tornado 44 is projected onto the projection screen 52 and appears, to the guests, to be in the distant horizon. Various pieces of scenery 48 begin to sway, fall over, give way or tear loose, moved by show action equipment 82 such as actuators controlled by the show controller 14. The canopy 40 above the guest viewing platform 12 ripples erratically from the strong gusts of wind. Props 58 appear to fly through the air right in front of the guests.

Suddenly, the man-made tornado 44 whirls into view. Windows of a building explode outwardly. More props 58 fly through the air. A vehicle is pushed into a fire hydrant, knocking it over and spraying the guests with water. Fire effects 56 are used to simulate the effect of a vehicle crashing into a gas pump which explodes. The canopy 40 lifts up to give the guests a view of the full man-made tornado 44.

Finally, the tornado 44 dies out. As the man-made tornado 44 dissipates and the sound of thunder fades away, the scene is slowly brightened. Suddenly, the wind dies, releasing pressure on the canopy 40 which collapses and suddenly appears to plunge down toward the guests. At the same time, the controller 14 energizes the actuator 22 attached to the floor of the guest viewing platform 12 causing it and the guests on it to drop down. The tornado experience has ended and the guests proceed to the exit.

Figure 5:
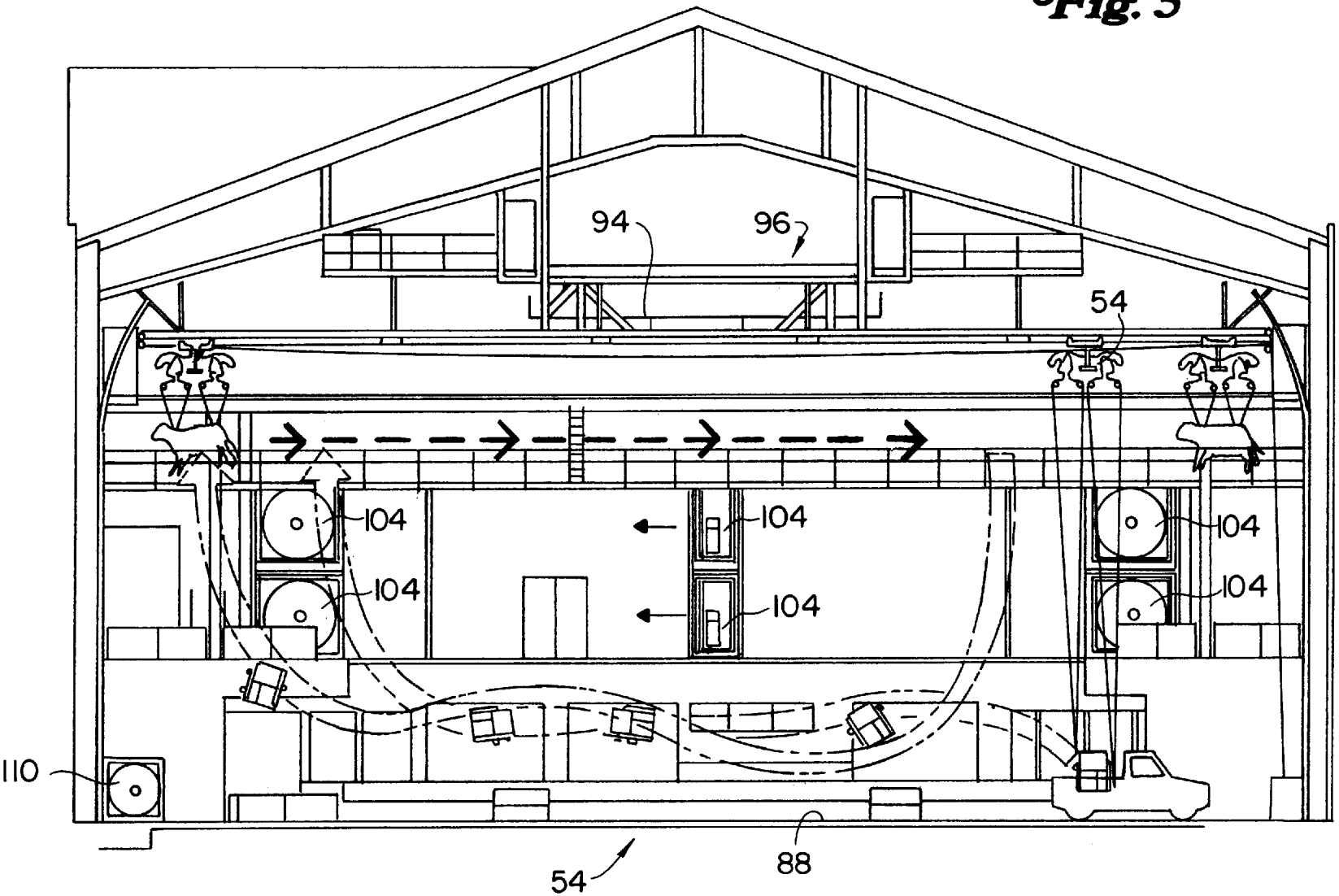
FIG. 5 is a front view of show action equipment used in the third setting.
Figure 9:
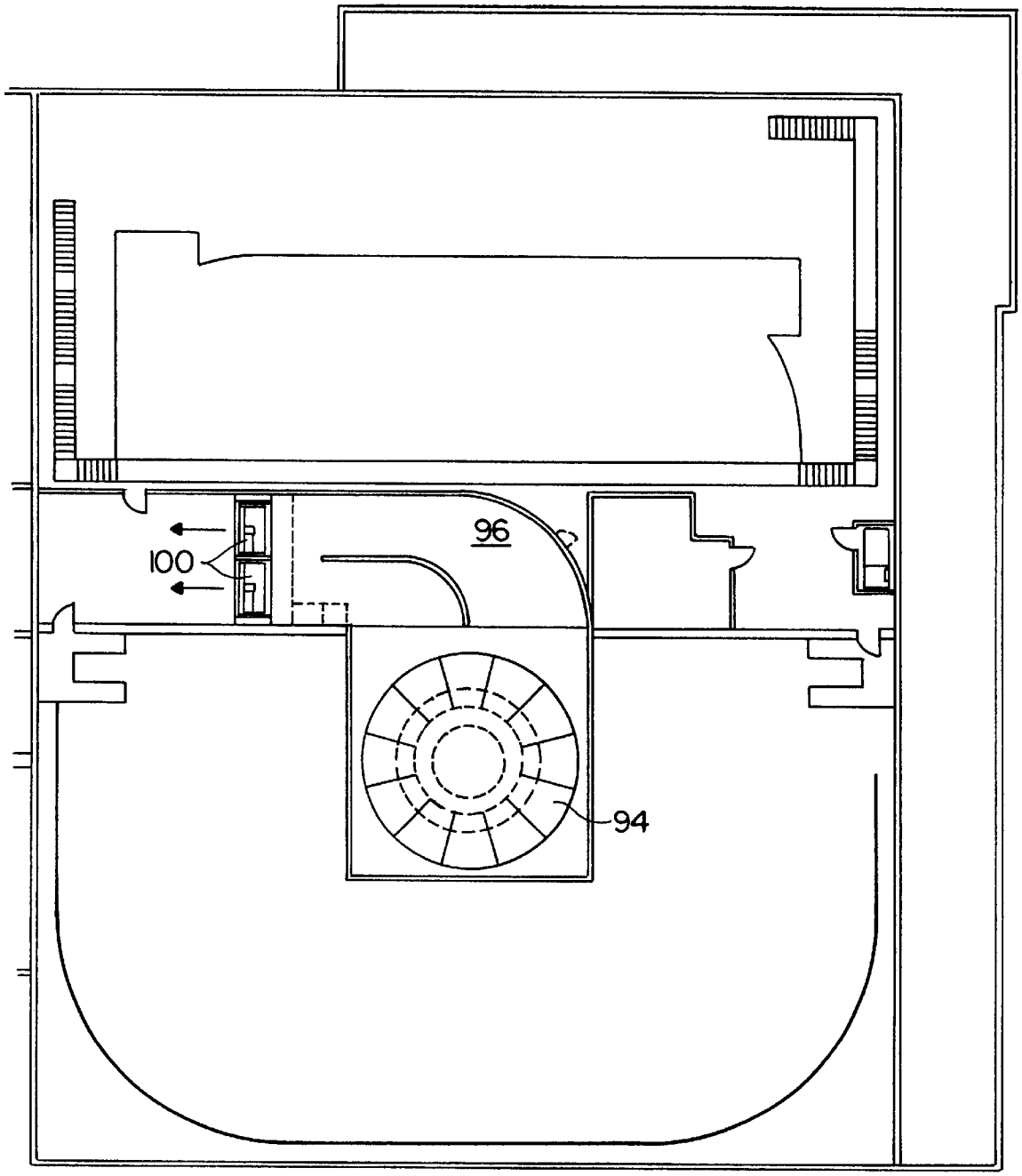
FIG. 9 is a plan view of the building shown in FIG. 1, showing the overhead bell mouth and air exhaust system.
Figure 10:
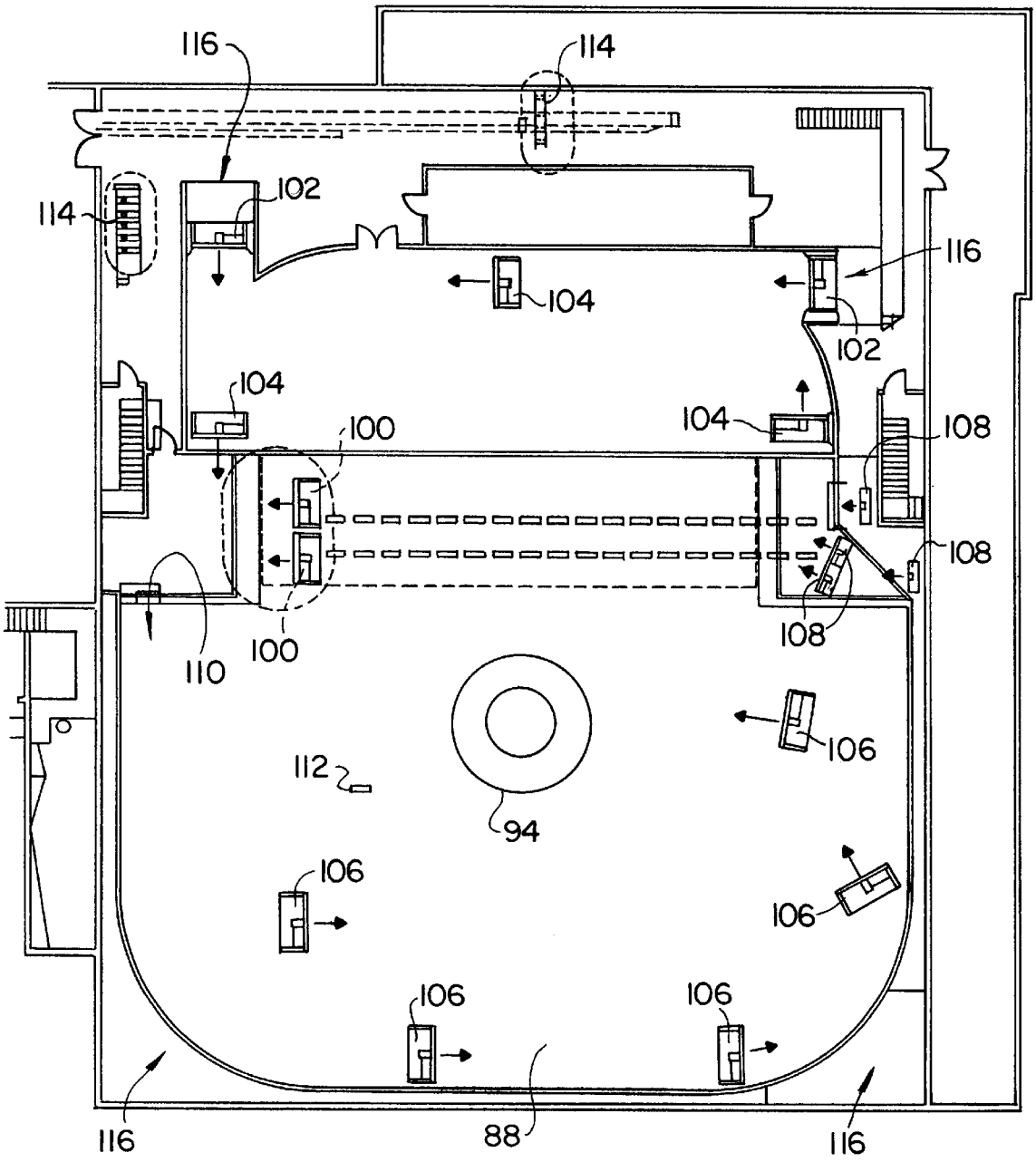
FIG. 10 is a plan view thereof showing preferred fan locations.
Figure 12:
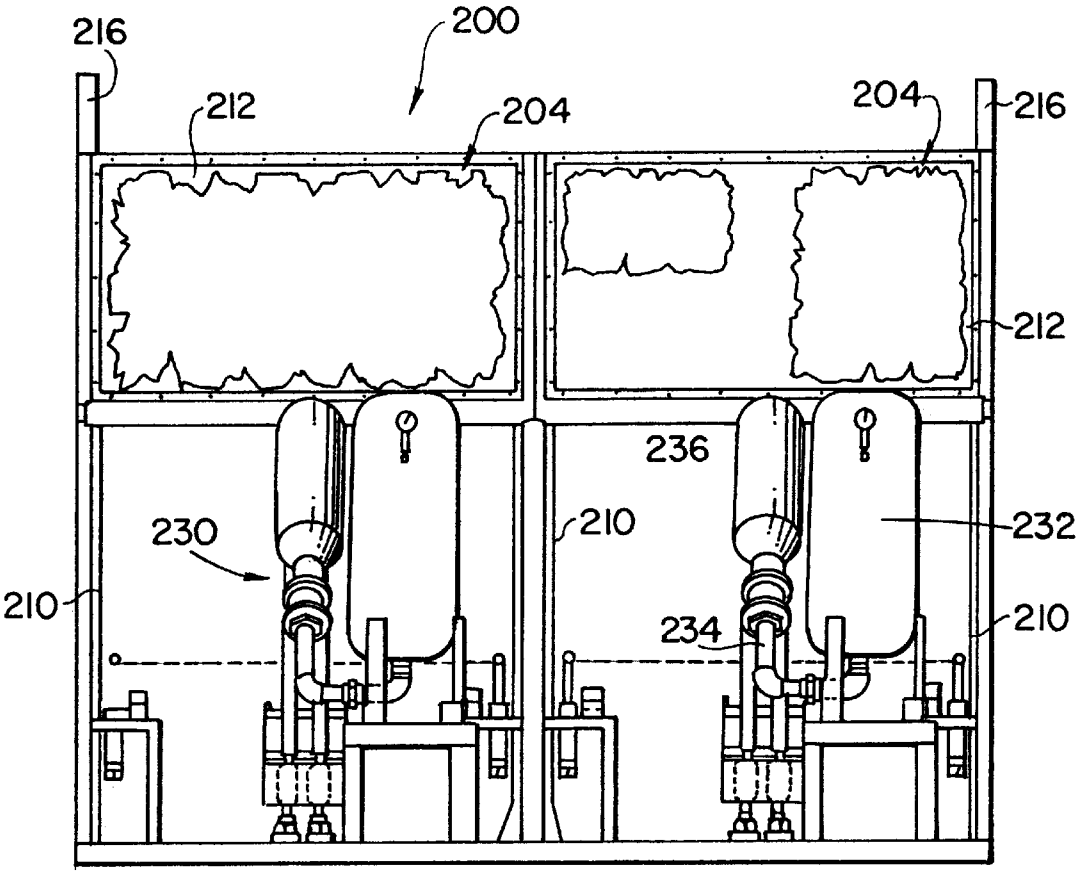
FIG. 12 is a rear view thereof.
Figure 11:
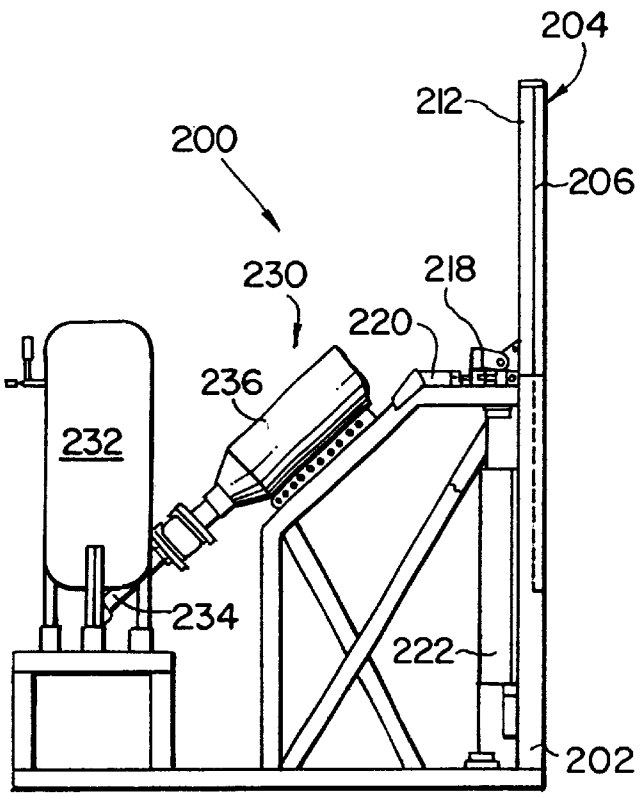
FIG. 11 is a side view of a simulated exploding window effect.
Figure 14:
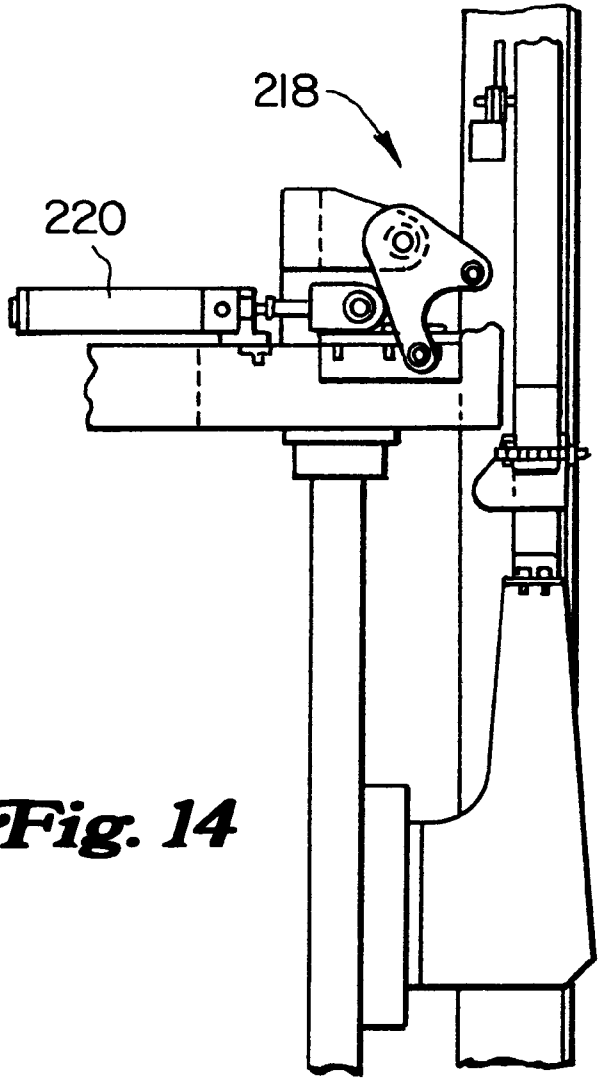
FIG. 14 is a detail view thereof showing the latch in the released position.
Figure 13:
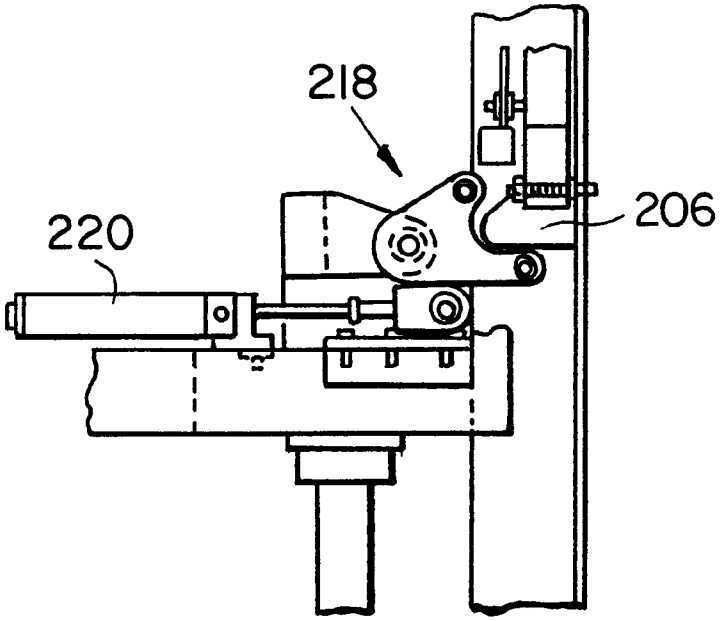
FIG. 13 is detail view of the latch shown in FIG. 11 with the latch engaged to the window.

Referring to FIGS. 5 and 10, the tornado generating system 90 includes fans which move air within the building 14 to create the tornado. As shown in FIGS. 9 and 10, exhaust fans 100 pull air upwardly through a bell mouth 94 located near the top of the building, and centrally located in front of the viewing platform 12. The exhaust fans 100 largely create upward vertical air movement, in the area below the bell mouth 94. Floor level circulating fans 106 on the floor 88 of the building 4, create circular air movement within the building, adjacent to the floor. Mezzanine level circulation fans 104 similarly provide circular air movement at greater elevations above the floor within the building. Intake fans 102 draw air tangentially into the building 4 through air inlets 116, in the same counter clockwise direction (when viewed from above, as in FIG. 10) as the air movement induced by the floor circulation fans 106. Guest fans 108 are positioned near the viewing platform 12, primarily to blow air over the guests in the viewing platform, so as to heighten the theatrical experience. This guest air, moved at e.g., 35 mph, also helps in maintaining the airflow in the building used to generate the tornado. The guest air is recirculated using the awning as a large intake scoop. An additional guest uptake fan 110 is positioned to the side of the viewing platform 12. One or more scenery fans 112 may be located within the building 4 to provide local air movement on or over a prop 58 or scenic element 30. Preshow fans 114 are located in the preshow areas, to provide air movement in those areas, as a theming element.

Table 1 below describes characteristics of the fans listed above, for use in a preferred embodiment.

| FUNCTION | QUANTITY | POWER (hp) | TOTAL FLOW RATING (kcfm) | ELEMENT NO. |
|---|---|---|---|---|
| Exhaust | 6 | 50 | 454 | 100 |
| Intake | 2 | 40 | 136 | 102 |
| Mezz Circ | 6 | 25 | 435 | 104 |
| Floor Circ | 5 | 25 | 362.5 | 106 |
| Guest | 4 | 15 | 182 | 108 |
| Uptake | 1 | 25 | 67.5 | 110 |
| Total | | 740 | 1637 | |

In the embodiment shown, the tornado diameter is about 4 feet at the bell mouth. Rotation is counter-clockwise when viewed from above. The bell mouth diameter at the entry is about 15 feet. Outside of the core area, rotational air speeds are relatively low, e.g., 3–5 knots. Spurious airflow or abnormal fan performance should be avoided, so that generation or maintenance of the tornado is not degraded or prevented. The preferred position and selection of fans, inlet and bell mouth as well as tornado performance, will necessarily vary with building size and configuration, number of guests, air temperature, humidity, and other factors.

Figure 8:
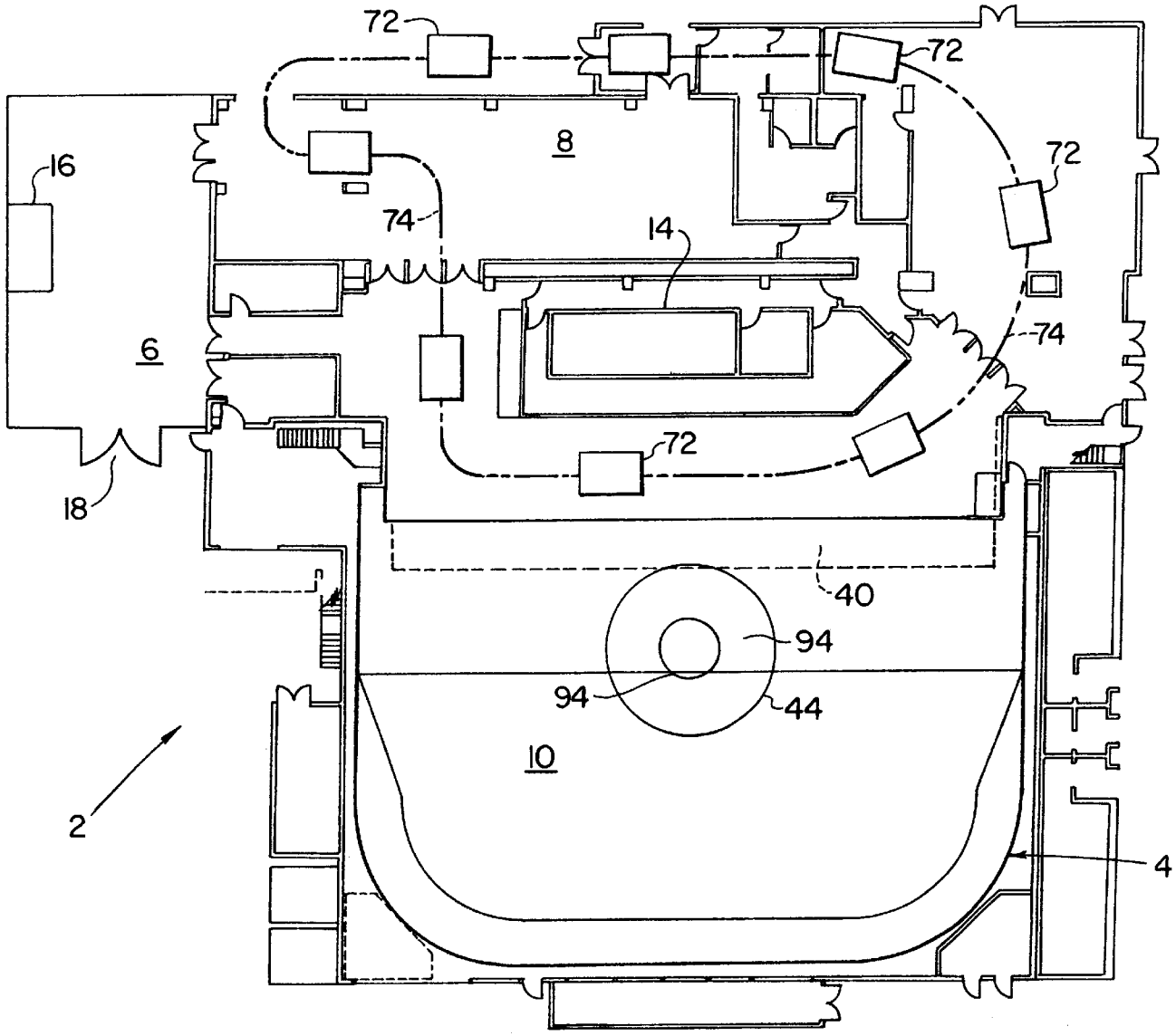
FIG. 8 is a plan view of a building used for an alternate embodiment of the amusement attraction of the present invention.

Referring now to FIG. 8, in an alternate embodiment, the guests view the amusement attraction from ride vehicles 72 that travel along a track or other pathway 74. Preferably, the guests board the ride vehicles 72 in the second setting 8. The ride vehicles 72 then travel through the second setting 8 and into the third setting 10 where they experience the special effects show and the man-made tornado 44. After the show is over, the ride vehicles 72 exit the third setting 10 and the guests disembark. The various special effects are controlled by a show controller 14 behind the platform 12.

Figure 3:
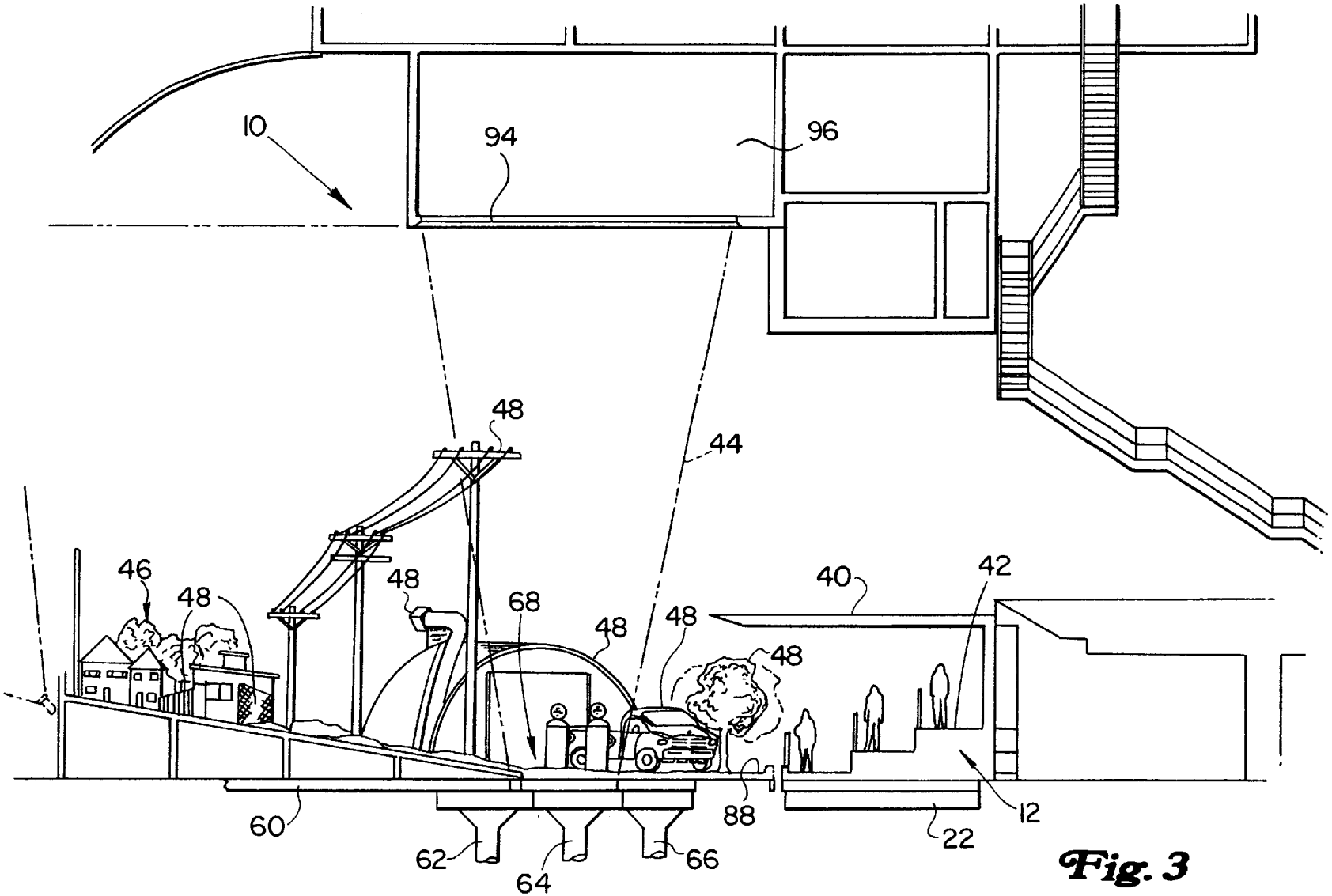
FIG. 3 is a side view of the third setting in the amusement attraction of the present invention.
Figure 4:
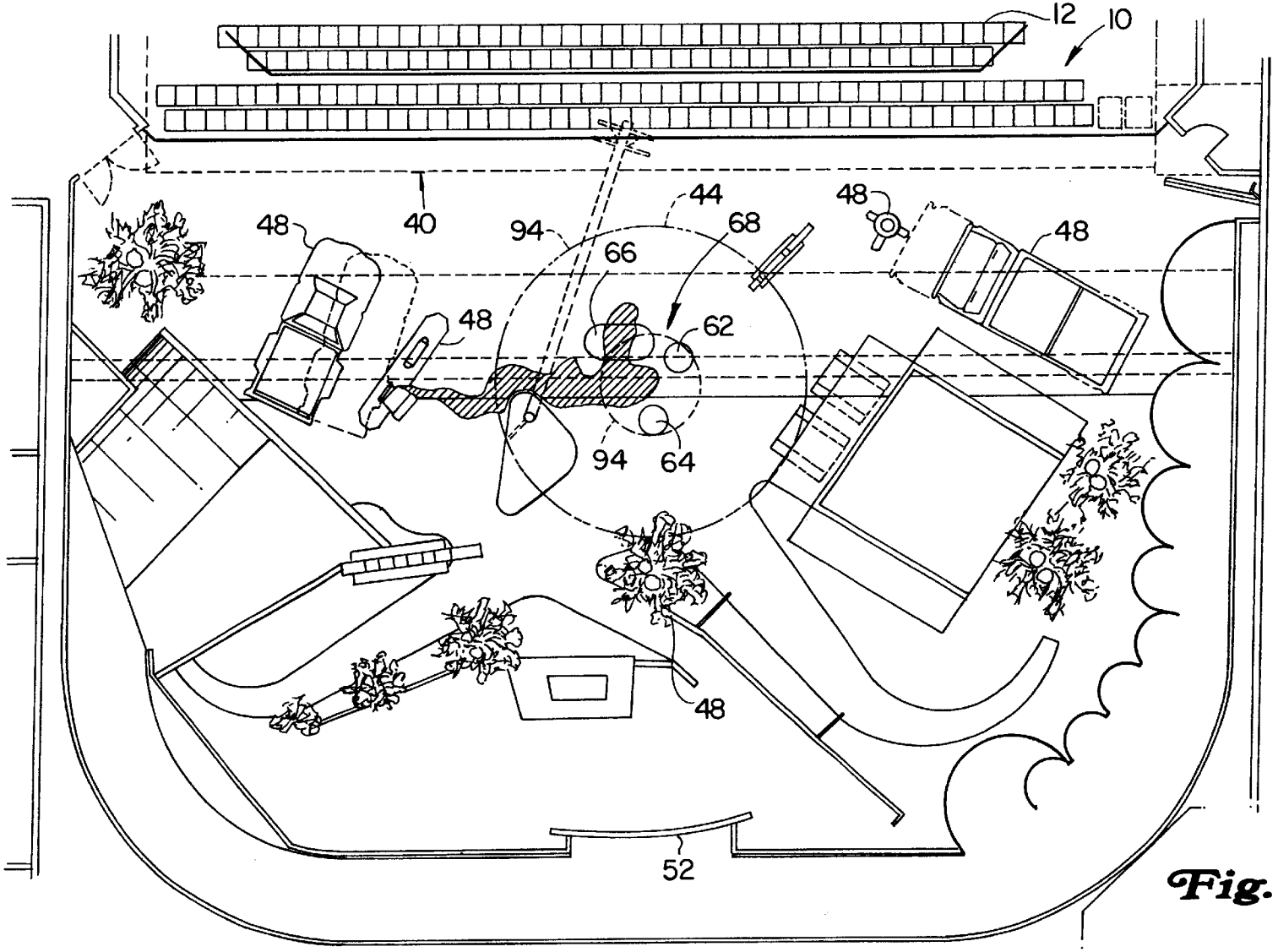
FIG. 4 is a plan view of the third setting.
Figure 6A:
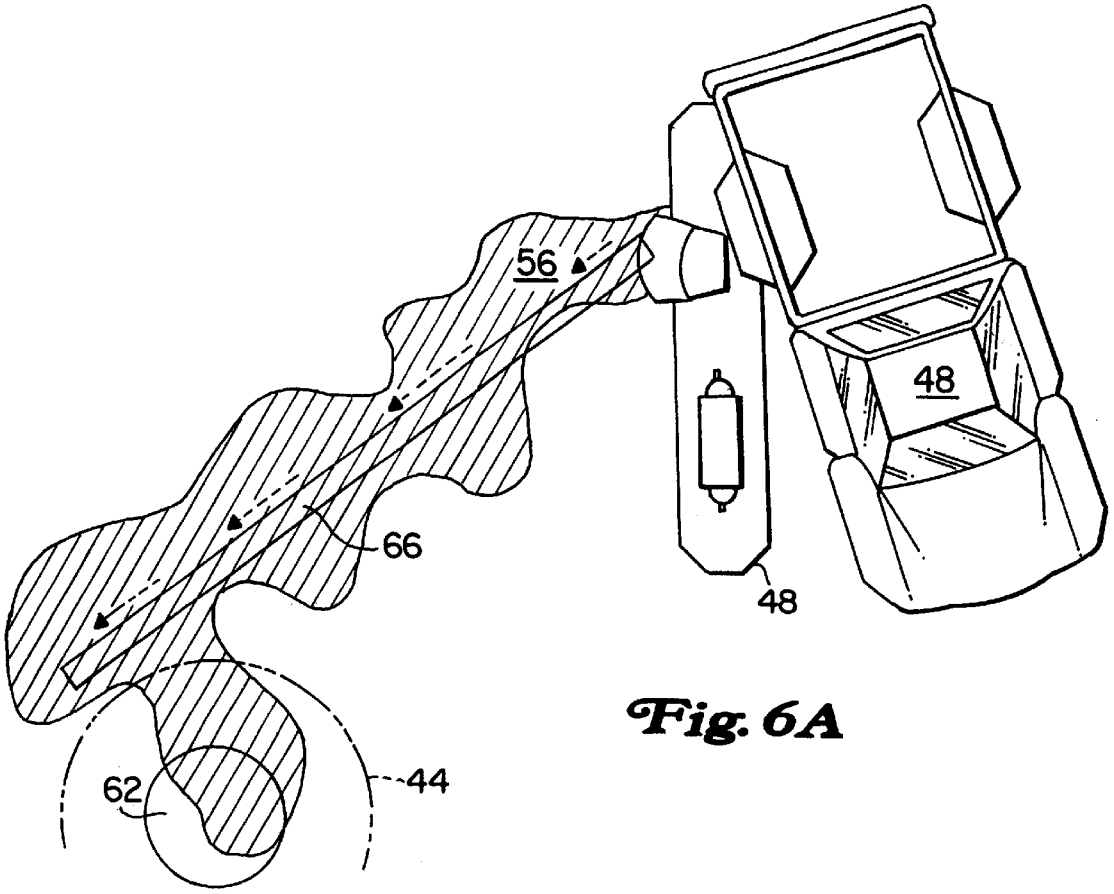
FIG. 6A is a partial plan view of the fire effects used in the third setting.
Figure 6B:
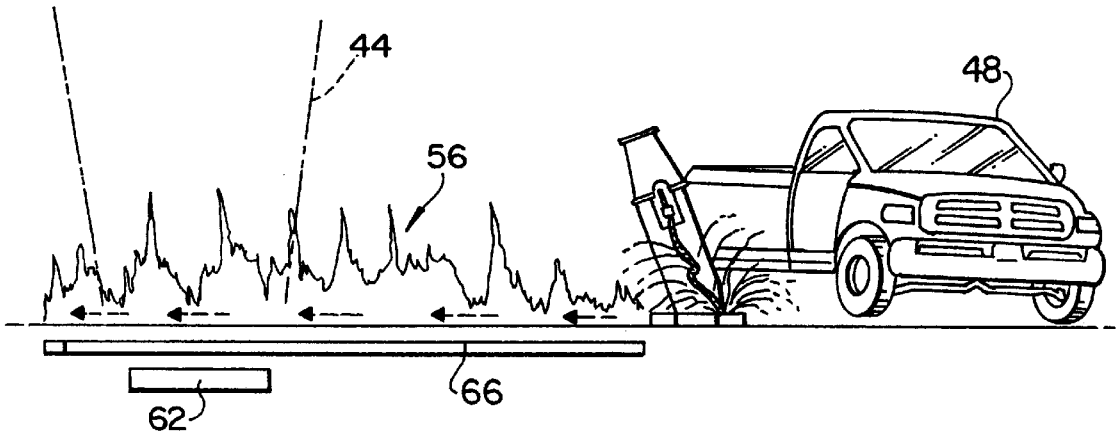
FIG. 6B is front view of the fire effects used in the third setting.

Referring to FIGS. 3, 4, and 6A, a trench 60 in the building floor runs from an equipment area (not shown) to a central floor location 68 directly under the bell mouth 94. Supply lines run from the equipment area through the trench 60 to supply natural gas, liquid nitrogen ($LN_2$), and steam to a gas manifold 66, and a steam /$LN_2$ manifold 62 and 64, at the floor location 68. The area around the floor location 68 is preferably flat, as obstructions can degrade tornado formation. The show controller 14 controls valves (and an igniter for the gas manifold), to provide visual effects, at appropriate times. Steam and $LN_2$ are mixed in the manifolds 62 and 64 to create a homogenous mixture and are then sprayed or released out of the manifolds 64 and 62 through a porous gravel/resin mix on the show floor, and into the base of the tornado, to provide a level of opacity and hence visibility, to the otherwise non-visible swirling air of the tornado. The gas manifold/igniter provides flames 56, preferably to simulate burning gasoline from a destroyed gasoline station. The $LN_2$ may optionally be sprayed in from a manifold at or near the bell mouth, and flow downwardly into the tornado.

Figure 7:
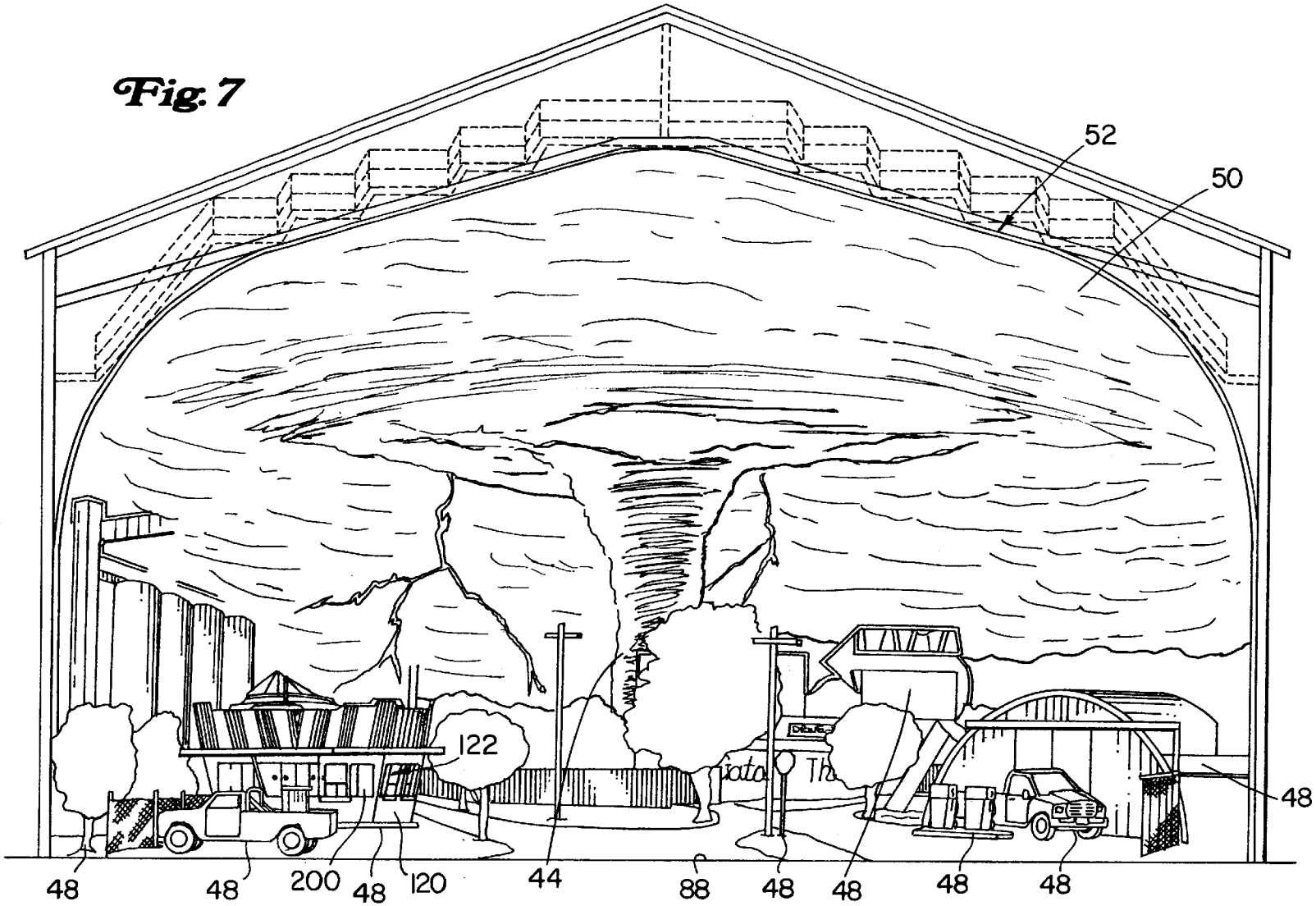
FIG. 7 is a front view of the projection effects used in the third setting.

Referring to FIG. 7, one scenery element 48 is a building 102 having windows 122. Referring to FIGS. 11–14, an exploding window effect 200 is provided within the building 120, to simulate windows exploding outwardly toward the tornado. The exploding window effect 200 is installed behind a wall 202 of the building 120, aligned with window openings 204 in the building 120.

The exploding window effect 200 includes solid continuous translucent windows 206 mounted on vertical guide rails 210. Springs 216 continuously urge the window 206 downwardly. However, a safety latch 218 prevents downward movement of the solid window 206 until the appropriate time.

A broken windowpane 212 is attached to the wall 202 behind the solid window 206. The broken windowpane 212 has jagged glass edges, simulating a blown out window.

A water canon 230 positioned behind the window openings 206 has a nozzle 236 connected to an accumulator tank 232 by a tank pipe 234.

In operation, the solid window 206 is translucent, but sufficiently opaque or dark to prevent viewers from seeing through it to the broken windowpane 212 behind the solid window 206. Alternatively, lighting effects can be used to prevent the viewers from seeing the broken window 212 behind the solid window 206. At an appropriate time, after the tornado has formed, the viewers initially see the solid window 206. The latch cylinder 220 is actuated by the show controller 14, releasing the solid window 206. The springs 216 rapidly drive the solid window 206 downwardly, in a fraction of a second. As this occurs, water spray and lighting effects can be used to conceal the downward movement of the solid window 206. As soon as the solid window 206 has dropped down, the show controller 14 actuates the water canons 230, to simulate the appearance of broken glass flying outwardly from the building 120. The water canon 230 uses compressed air in the accumulation tank 232 to quickly drive water out of the tank 232, through the tank pipe 234 and into the nozzle 236. The nozzle 236 sprays water droplets, having appropriate droplet sizes and spray patterns out through the opening in the blown out window 212.

The viewers see the tornado approaching the building 120, followed by the flying broken glass effect created by the water canons 230, and then by the appearance of the now blown out windows 212. After the show is over and the viewers have left the viewing platform, the show controller 14 actuates the reset cylinder 222. The reset cylinder 222 pushes up on the bottom of the frame of the solid window 206. The latch cylinder 220 is reversed to reengage the window 206, and to hold the window 206 in position over the broken window 212 against the downward force of the springs 216, until released for the next show. In an alternate embodiment, the blown out windows 212 may also move on the vertical rails, in the same way as the solid windows 206, so that the windows 212 and 206 trade places in a fraction of a second. In this embodiment, the solid window 206 can be entirely transparent, as it does not need to conceal the blown out window 212 at any time.

Thus, a novel amusement attraction and special effects have been shown and described. Various modifications and substitutions of equivalents may of course be made without departing from the spirit and scope of the invention. The inventions, therefore, should not be limited, except to the following claims and their equivalents.

What is claimed is:

1. An amusement attraction comprising:

a building;

scenic elements arranged within the building;

a stationary guest viewing area in the building; and a tornado generating system in the building.

2. The amusement attraction of claim 1, further comprising a plurality of different settings within the building.

3. The amusement attraction of claim 2, further comprising a pathway connecting the plurality of different settings.

4. The amusement attraction of claim 2, whereby at least one of the settings includes an audio visual presentation.

5. The amusement attraction of claim 2, whereby scenic elements are arranged in at least one of the settings to resemble a tornado-damaged building.

6. The amusement attraction of claim 2, whereby scenic elements are arranged in at least one of the settings to resemble an outdoor scene.

7. The amusement attraction of claim 1, further comprising a controller for controlling the scenic elements.

8. The amusement attraction of claim 1, whereby the scenic elements further comprise at least one of moving scenery, show action equipment, special effects and static props.

9. The amusement attraction of claim 8, whereby the special effects include at least one of sound effects, lighting effects, fire effects, moving image projection effects, and dropping water onto the guest viewing area.

10. The amusement attraction of claim 1, further including an actuator linked to at least one of the scenic elements for moving the scenic element to simulate the effect of a tornado on the scenic element.

11. The amusement attraction of claim 1, further comprising show action equipment for moving a scenic element through the air in front of the guest viewing area, to simulate the effect of a wind blown object.

12. The amusement attraction of claim 1, whereby the guest viewing area is a platform within the building.

13. The amusement attraction of claim 12, further including a platform actuator attached to the platform to move the platform down vertically to simulate the effect of a floor collapsing.

14. The amusement attraction of claim 1, further comprising a steam or $LN_2$ delivery system in the building, to provide a visual media for a tornado created by the tornado generating system.

15. The amusement attraction of claim 1, further including a projection screen and a projector for projecting images onto the screen with the tornado generating system positioned to generate a tornado at a location between the projection screen and the guest viewing area.

16. An amusement attraction comprising:

a building;

a show setting in the building;

a stationary audience area in the building adjacent to the show setting;

a screen associated with the show setting;

a projector for projecting images onto the screen;

show action actuators linked to props movable in the show setting;

a tornado generating system in the show setting for generating a tornado, between the screen and audience; and a show controller linked to the projector, show action actuators and the tornado generating system.

17. The amusement attraction of claim 16, further comprising an audio system linked to the show controller.

18. An amusement attraction comprising:

a building;

a tornado generating system in the building;

a guest viewing area in the building;

an exploding window system comprising:

vertical guide rails fixed within a wall;

a translucent window slidable in the guide rails, the translucent window spring-biased in a downward direction;

a controllable latch mechanism adjacent to the wall for restraining and releasing the translucent window; and a broken window pane fixed relative to the wall and positioned behind the translucent window.

19. An amusement attraction comprising:

a building;

scenic elements arranged within the building;

a guest viewing area in the building;

a moveable canopy above the guest viewing area; and a tornado generating system in the building.

* * * * *